United States Patent [19]

Zemlok et al.

[11] Patent Number: 5,023,598

[45] Date of Patent: Jun. 11, 1991

[54] DIGITAL SIGNAL PROCESSOR FOR ELECTRONIC ARTICLE GATES

[75] Inventors: Kenneth C. Zemlok, Shelton; Andrei Obrea, Bethel, both of Conn.

[73] Assignee: Pitney Bowes Inc., Stamford, Conn.

[21] Appl. No.: 459,610

[22] Filed: Jan. 2, 1990

[51] Int. Cl.[5] ..... G08B 13/18

[52] U.S. Cl. ..... 340/572

[58] Field of Search ..... 340/572

[56] References Cited

U.S. PATENT DOCUMENTS

| | | | |
|---|---|---|---|
| 4,168,496 | 9/1979 | Lichtblau | 340/572 |
| 4,812,822 | 3/1989 | Feltz et al. | 340/572 |
| 4,859,991 | 8/1989 | Watkins et al. | 340/572 |
| 4,888,579 | 12/1989 | ReMine et al. | 340/572 |

*Primary Examiner*—Glen R. Swann, III

*Attorney, Agent, or Firm*—Peter Vrahotes; Melvin J. Scolnick; David E. Pitchenik

[57] ABSTRACT

A frequency-swept electromagnetic field is generated in an interrogation zone and signals received from the interrogation zone are processed to detect the presence of a marker with a resonant tank circuit in the zone. Detection is achieved by the use of averaging techniques of a plurality of sweeps wherein peaks above a defined level are stored in a persistence table. A symmetry test is made on the peaks and if the peaks are persistence and symmetrical the presence of a marker is indicated since background noise will not exhibit persistence and symmetry.

6 Claims, 2 Drawing Sheets

DIGITAL SIGNAL PROCESSOR FOR ELECTRONIC ARTICLE GATES

BACKGROUND OF THE INVENTION

Electronic security systems have been developed and used commercially for the purpose of detecting the presence of a marker within an interrogation zone. One type of such system is a radio frequency (RF) system that is used to detect the presence of a resonant tank circuit. An example of a resonant tank circuit is a tuned tank circuit that includes an inductor with a capacitor connected across the inductor terminals for the purpose of either modifying transmissions from an antenna, or retransmitting at its resonant frequency a signal which is received and amplified by the resonant tank circuit. The resonant tank circuit is tuned to a preselected frequency of the transmitter. The transmitter sweeps a range of frequencies centered about the expected marker resonant frequency. The tank circuit retransmits a signal which is detected by a receiver. Upon the signal being detected by the receiver, an alarm is set off to indicate the presence of the tank circuit in the interrogation zone.

In an ideal world, the interrogation zone would only have the electromagnetic field that has been generated by the antenna of the system. Unfortunately, in the real world, large numbers of devices transmit electromagnetic fields that overlap with the interrogation zone. As a consequence, the receiver of the detection system will receive these latter signals, which are referred to as white noise or background noise, and could inadvertently sound an alarm even though a tank circuit is not present within the interrogation zone. These false alarms can create serious problems in any implementation of a security system. There is the obvious difficulty with a customer being delayed and annoyed when a false alarm is tripped, and there is also the need to monitor the system after false alarms have been generated to prevent additional false alarms.

It clearly would be desirable to have an electronic surveillance system that has the capability of isolating, or sequestering, the background noise so that upon the entrance of a resonant tank circuit into the interrogation zone, it can be detected with a higher level of confidence.

SUMMARY OF THE INVENTION

A system has been devised having a program whereby background noise can be accounted for by the receiver of an electronic detection system. This is accomplished by five processing steps applied to the interrogation received signal. The first step is an averaging of the incoming signal over successive sweeps. The second step involves finding all the peaks above a certain level and recording the position and magnitude of each peak. The third step is to find marker like shapes in the peaks found in the second step. The fourth step involves a symmetry test. It has been found that random noise and CW (continuous wave electromagnetic noise) signals will not consistently appear in both the up and down sweeps, whereas the resonating signal from a tag will do so. The last step is to determine the persistence of a particular symmetrical shape. Background noises will not be persistent over time, whereas the signal from a marker will exhibit persistence. Based upon these steps, the presence of a tuned circuit within the interrogation zone can be determined.

DETAILED DESCRIPTION OF THE PREFERRED EMBODIMENTS

Figure 1:
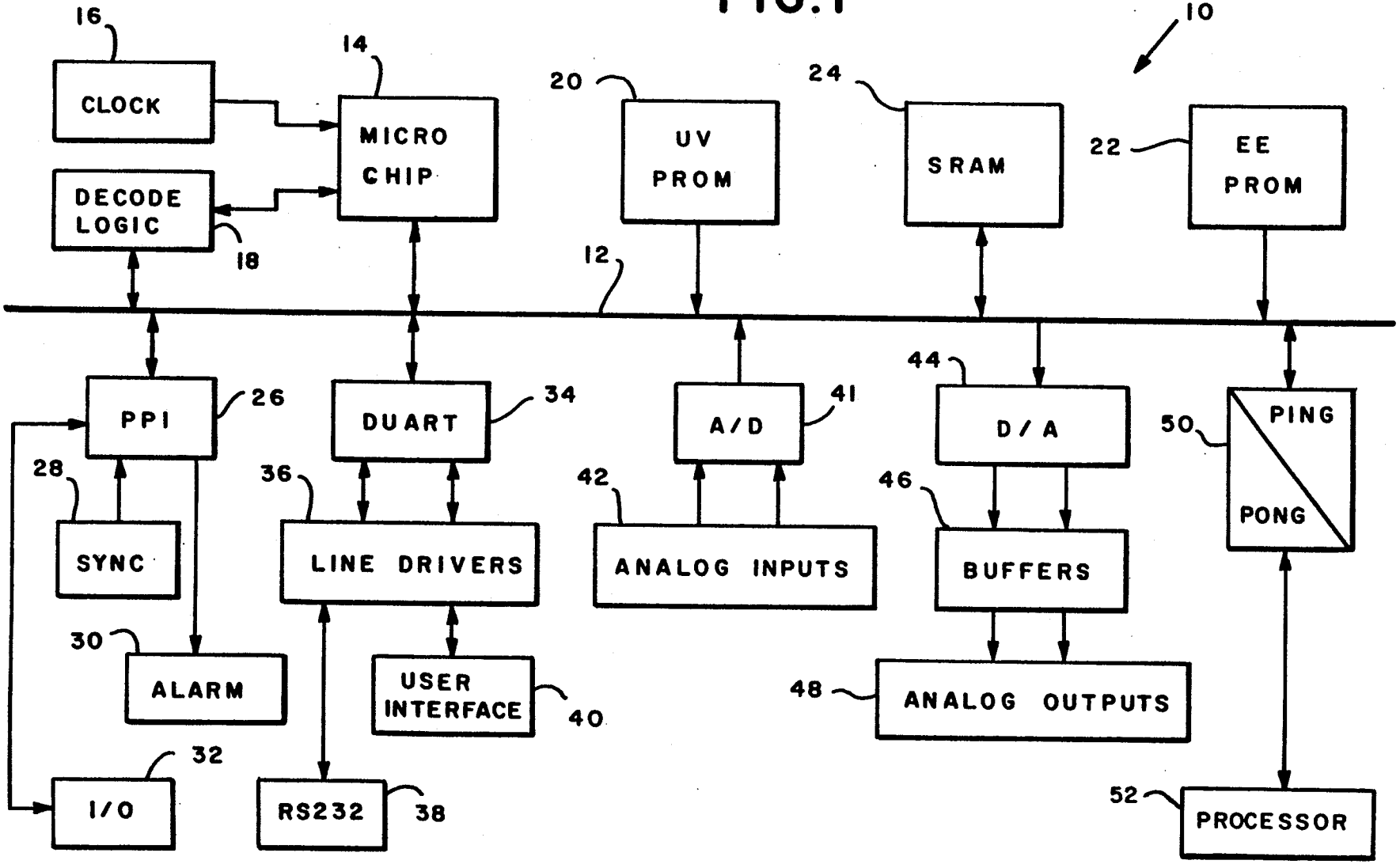
FIG. 1 is a block diagram of the circuitry for the detection system of this invention.

With reference to FIG. 1, circuitry is shown generally at 10, in block diagram form, which is a representation of a system that can be used to carry out the instant invention for the purpose of determining if a marker with a resonant tank circuit is present in an interrogation zone. The system 10 has a central bus 12 which provides a communication link for the units of the system. A microchip 14 which would include a CPU and DMA, such as an Intel 80186 chip, is in communication with the bus 12, and a clock 16 communicates with the microchip to provide a timing pulse thereto. A logic decoder 18, which can be a series of gates, is in communication with microchip 14 and the bus 12 for the purposes of providing random logic decoding of messages sent from other units of the system 10 for the benefit of the microchip 14. A pair of PROMS 20, 22 are in communication with the bus 12. The one PROM 20 stores the control program and is erasable by the application of ultraviolet light, and the other PROM 22 is an EEPROM which stores parameters of the algorithm that will be discussed hereinafter. A static RAM 24 is in communication with the bus 12 and exchanges temporary data with the other units of the system 10. A programmable peripheral interface 26, such as an Intel 8255, is in communication with the bus 12 and a synchronizer 28. The synchronizer 28 is in communication with the gates that generate the electromagnetic field within the interrogation zone. After interrogation of the synchromizer 28, the PPI informs the microchip 14 when a sweep of the field starts and also provides communication between the microchip and peripherals such as an alarm 30 and input/output ports 32. A dual universal asynchronous receiver transmitter 34 (DUART) is in communication with the bus and converts the serial signals to a parallel format. A line driver unit 36 is in communication with the DUART, to provide translation of electrical signals for an RS232 input port 38. The line driver unit 36 is in communication with the RS232 input port 38 and a user interface unit such as a personal computer or a voice output device.

Figure 2:
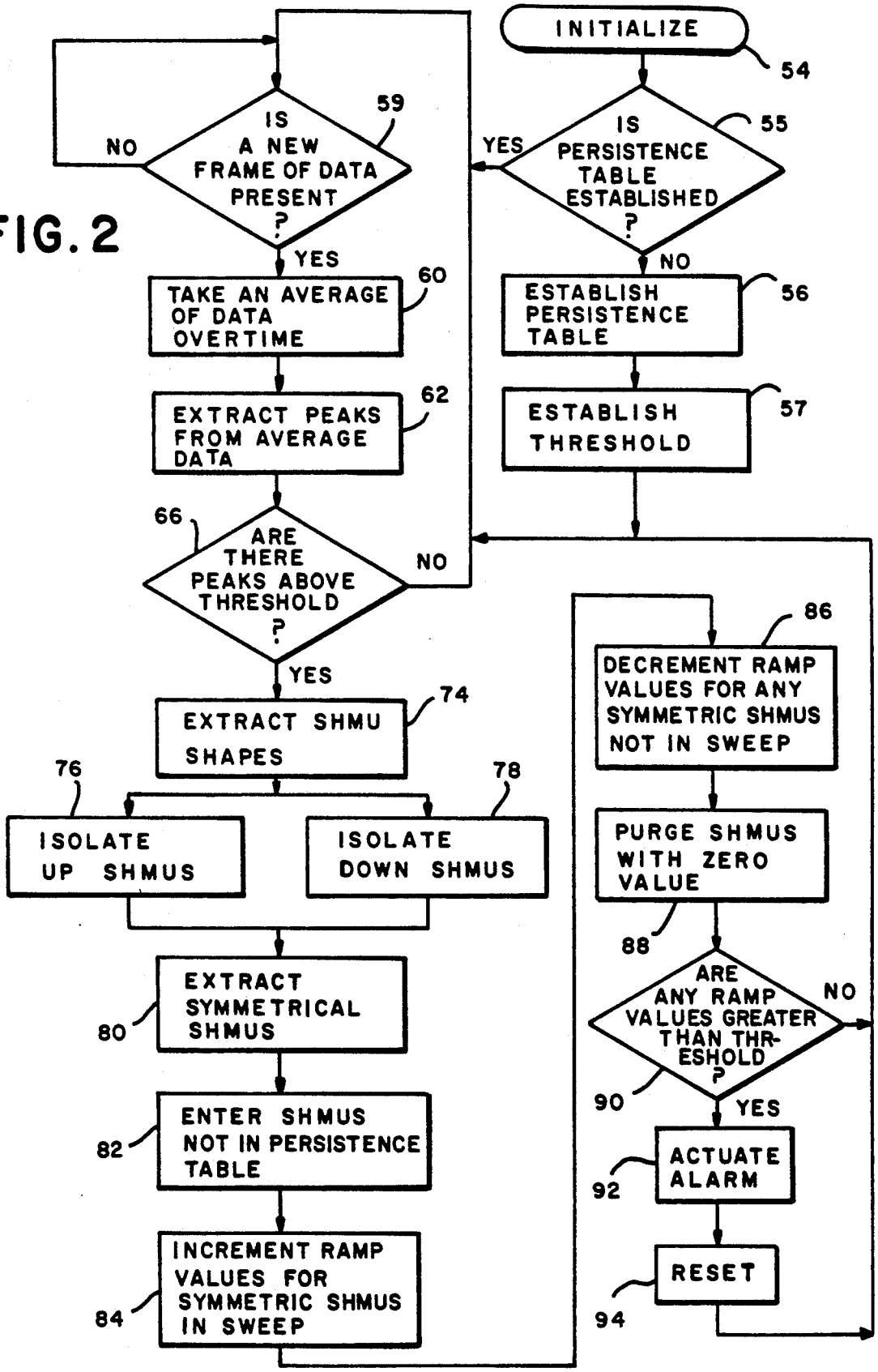
FIG. 2 is a flow chart describing the program for controlling the circuitry shown in FIG. 1.

An analog-to-digital converter (A/D) 41 is in communication with the bus 12 and receives analog inputs 42, such as from a detection gate. A digital-to-analog converter (D/A) 44 is in communication with the bus 12 and with buffers 46 which output data through analog outputs 48. A ping-pong memory 50 is in communication with the bus 12 and with a processor 52 such as a Texas Instrument Model TMS 320C10. The ping-pong memory 50 is a memory divided into two equal sections and serves to exchange data communicated between the bus 12 and the processor 52 by interchanging communication with the two ping-pong memory sections. The processor 52 generates a persistence table using averaged data received from the memory 50 as will be described hereinafter with reference to FIG. 2.

In operation, the user will input control information into the SRAM 24 by way of the microchip 14, initially establishing a persistence table and threshold peaks in the processor 52. The term persistence is defined as the presence over an extended period. The persistence table stores those signals which are present over a long term. After the system is initialized (54 of FIG. 2), analog signals will be received at the input 42, which signals can come from the receiver of an interrogation zone gate upon completion of each frequency sweep. For example, the system 10 sweeps from 7 MHz to 9 MHz. The marker used will generally resonate at 8 MHz. In any system of this type, the sweep frequencies should be centered on the expected resonant frequency of the marker. The analog signals are converted to digital signals by the A/D 41 and subsequently uploaded to the microchip 14 where, under control of the PROM 22, the question will be asked whether a persistance table has been established (55 of FIG. 2). If not, a persistence table is established 56 and a threshold for peak valves 57 is set. If the response to the inquiry is positive, or after establishment of the persistence table and threshold, the question is asked whether new data is present 59. If no new data is present, there is a return. If there is new data present, an average of the data is taken over time 60 and the peaks from this average are extracted 62. The question is then asked whether the peaks are above the established threshold 66. If there are no such peaks above the threshold, there is a return, but if there are new peaks, these peaks are extracted 74. These peaks are inspected for marker-like signal shapes and referred to as SHMU's, i.e., a SHMU is defined as a shape-recognized sequence of peaks. After extraction of the SHMU's, they are sorted into up-sweep SHMU's and down-sweep SHMU's, 76, 78, i.e., those occurring during the up-sweep and those occurring during the down-sweep of the field frequency, respectively. The symmetrical SHMU's are then extracted from the up-sweep and down-sweep SHMU's 80, symmetrical SHMU's being those that have a corresponding SHMU of similar value but of opposite direction i.e. SHMU's occuring during both the up-sweep and down-sweep. Symmetrical SHMU's extracted that were not previously in the persistence table are then entered into the persistence table 82. The persistence table contains ramp values at specific frequencies at which symmetrical SHMU's were detected. These ramp values are updated on every sweep. For each sweep, the ramp values will be incremented a finite value for all symmetrical SHMU's 84 found in such sweep 84. The ramp value will be decremented a finite value for those symmetrical SHMU's in the persistence table that were not found to be symmetrical on this sweep 86.

By incrementing and decrementing ramp values, a history or pattern is developed whereby the persistence of symmetrical SHMU's can be established for a long term determination relative to individual symmetrical SHMU's to see if they are persistent. More specifically, the repeated presence of symmetrical SHMU's during a large number of sweeps will result in a large ramp value as a result of repeated increments. Thus, the ramp values in the persistence table are accumulative as a result of many detections. The opposite is true for not having found various symmetrical SHMU's in the sweeps. Those in the persistence table that are not found to re-occur for several sweeps will be eventually be eliminated from the persistence table 88.

An inquiry is made whether there are any ramp values greater than a ramp threshold value 90. If there is, this is an indication a marker is in the interrogation zone and an alarm is enabled 92. After the alarm has sounded for any selected period, upon resetting the alarm manually 94 or removal of the interrogated marker from the interrogation zone, the alarm will be disabled. If there are no ramp values greater then the threshold, there is a return to the beginning of the program.

Thus, what has been shown and described is a system 10 whereby a signal is received from the receiver 48 of an interrogation gate in the form of a electromagnetic wave. This wave is first averaged, the peaks of the averaged waves are extracted, these peaks are segregated by shape and examined for purpose of symmetry, and if such symmetry is found persistently, this is an indication that a detectable maker is within the interrogation zone. Upon the detection of such a maker, the alarm, whether it be a bell, whistle, siren, or flashing lights, will be activated.

What is claimed is:

1. An article surveillance system for processing signals that includes a generator for generating a frequency sweeping electromagnetic field within an interrogation zone, a receiver for receiving signals that are induced in a marker within such zone for the purpose of detecting the presence of a marker and an alarm in communication with the receiver for indicating the presence of a marker in the interrogation zone, the signal receiver comprising:

means for averaging the signals received over time, means for extracting peaks from said signals received, means for creating a peak threshold, means for identifying peaks above said threshold, means for extracting SHMU's, shape-recognized sequences of peaks corresponding to the presence of a marker, from said identified peaks, means for separating up-sweeping SHMU's from down-sweeping SHMU's, means for determining symmetrical SHMU's i.e., those present during both "up" and "down" sweeps, means for establishing a persistence table containing signals corresponding to SHMU's present over a determined number of up-sweep and down-sweep cycles, means for entering signals corresponding to new symmetrical SHMU's into said persistence table, and means for determining if the number of cycles of the signals corresponding to symmetrical SHMU's in said persistence table is, above a threshold, whereby upon a finding that the number of cycles of signals corresponding to symmetrical SHMU's in the persistence table is above said threshold, the signal receiver will enable the alarm.

2. The system of claim 1 including: means for establishing said signals corresponding to symmetrical SHMU's as ramp values in said persistence table, means for updating said ramp values in successive sweeps by incrementing the ramp values upon finding symmetrical SHMU's and decrementing the ramp value upon not finding symmetrical SHMU's, means for establishing a ramp threshold, and means for determining if the ramp threshold has been exceeded.

3. The system of claim 2 including means for activating an alarm if the ramp values of the symmetrical SHMU's are above said threshold.

4. An article surveillance system for processing signals that includes a generator for generating a frequency sweeping electromagnetic field within an interrogation zone, a receiver for receiving signals that are induced in a marker within such zone during frequency sweeps for the purpose of detecting the presence of a marker and an alarm in communication with the signal receiver for indicating the presence of a marker, the signal receiver comprising:

means for averaging the signals received over time,
means for extracting peaks from signals received,
means for creating a peak threshold,
means for identifying signals above said peak threshold,
means for extracting SHMU's, shape-recognized sequences of peaks corresponding to the presence of a marker, from said identified signals,
means for separating up-sweeping SHMU's from down-sweeping SHMU's,
means for determining the presence of symmetrical SHMU's, i.e., those present during both "up" and "down" sweeps,
means for establishing a persistence table having a ramp value for each detected symmetrical SHMU,
means for entering ramp values corresponding to said symmetrical SHMU's into said persistence table,
means for updating the ramp values during each frequency sweep,
means for determining if ramp values corresponding to symmetrical SHMU's are already in the persistence table,
means for entering newly detected symmetrical SHMU's into said persistence table,
means for establishing a ramp value threshold in said persistence table,
means for determining if any ramp value in said persistence table is greater than said ramp value threshold, and
means for enabling the alarm if the ramp value of any SHMU is above said ramp value threshold.

5. A process for determining the presence of a tuned tank circuit in an interrogation zone, the steps comprising:

generating a frequency sweeping electromagnetic field in the interrogation zone,
receiving signals from the interrogation zone,
averaging the signals received over time,
extracting peaks from said averaged signals,
creating a peak threshold,
identifying peaks above said peak threshold,
extracting SHMU's, shape-recognized sequences of peaks corresponding to the presence of a marker, from said peaks above said peak threshold,
separating up-sweeping SHMU's from down sweeping SHMU's,
establishing a persistence table of symmetrical SHMU's,
determining symmetrical SHMU's i.e., those present during both up-sweeps and down-sweeps,
entering determined symmetrical SHMU's into the persistence table,
establishing an alarm threshold for the number of cycles any symmetrical SHMU is present in said persistence table,
determining if any symmetrical SHMU remains in the persistence table for a number of cycles above said alarm threshold, and
sounding an alarm upon finding any symmetrical SHMU remaining a number of cycles above said alarm threshold.

6. A process for determining the presence of a tuned tank circuit in an interrogation zone, the steps comprising:

generating a frequency sweeping electromagnetic field in an interrogation zone,
receiving signals from the interrogation zone,
averaging the signals received over time,
extracting peaks from said averaged signals,
creating a peak threshold,
identifying peaks above said peak threshold,
extracting SHMU's, shape-recognized sequences of peaks corresponding to the presence of a marker, from said peaks,
separating up-sweeping SHMU's from down-sweeping SHMU's,
determining the presence of symmetrical SHMU's i.e., those present during both "up" and "down" sweeps,
establishing a persistence table having a ramp value for each detected symmetrical SHMU,
updating the ramp values in the persistence table during each sweep by incrementing the ramp values for symmetrical SHMU's found during each sweep and decrementing the ramp values for symmetrical SHMU's not found during the sweep,
establishing a ramp value threshold in said persistence table,
determining if any ramp value is are above said ramp value threshold,
and sounding an alarm upon the finding of any ramp value above the ramp value threshold.

* * * * *